United States Patent [19]

Fangmeyer

[11] 4,275,838

[45] Jun. 30, 1981

[54] ROTATING ATOMIZING DEVICE

[75] Inventor: Dennis L. Fangmeyer, Indianapolis, Ind.

[73] Assignee: Ransburg Corporation, Indianapolis, Ind.

[21] Appl. No.: 13,125

[22] Filed: Feb. 21, 1979

Related U.S. Application Data

[63] Continuation-in-part of Ser. No. 832,587, Sep. 12, 1977, abandoned.

[51] Int. Cl.[3] ..... B05B 3/10

[52] U.S. Cl. ..... 239/223; 118/302; 118/626; 239/112; 239/703

[58] Field of Search ..... 239/700–703, 239/112, 222.11, 222.13, 223, 224, 240; 118/302, 323, 626; 159/4 A, 4 S, 6 R

[56] References Cited

U.S. PATENT DOCUMENTS

| | | | |
|---|---|---|---|
| 1,853,682 | 4/1932 | Hechenbleikner | 239/223 |
| 2,711,926 | 6/1955 | Allander | 239/224 |
| 3,011,472 | 12/1961 | Kent et al. | 118/626 |
| 3,358,931 | 12/1967 | Wirth | 239/223 |

*Primary Examiner*—Johnny D. Cherry
*Attorney, Agent, or Firm*—Jenkins, Coffey, Hyland, Badger & Conard

[57] ABSTRACT

An apparatus for atomizing and dispensing a coating material includes a turbine having a housing and a shaft for rotatably supporting an atomizing device. The shaft includes an outer end extending from the housing for mounting the atomizing device. The shaft outer end includes a tapered portion, and the atomizing device includes a central tapered aperture for receiving the tapered portion of the shaft outer end. The housing is divided into a high-pressure side and a low-pressure side by a nozzle plate which directs the flow of compressed air from the high-pressure side across a driven wheel mounted on the shaft adjacent the nozzle plate. The high-pressure side lies between the atomizing head and the nozzle plate so that compressed air moving through the nozzle plate and the driven wheel to the low-pressure side flows away from the atomizing head. This motor arrangement minimizes parasitic air leakage around the shaft and disturbances to the film of coating material on the atomizing device which could result from such parasitic leakage.

7 Claims, 8 Drawing Figures

ROTATING ATOMIZING DEVICE

This is a continuation-in-part of copending United States Patent application Ser. No. 832,587, filed Sept. 12, 1977, titled ROTATING ATOMIZING DEVICE, assigned to the same assignee as this application, and now abandoned.

This invention relates to atomization and deposition of fluid coating materials such as paints, and more particularly to a drive motor for an atomizing device, and an atomizing device configuration.

Various types of atomizing devices, coating material feeds, drive mechanisms and coating methods are well-known. See, for example, the following United States Patents: Juvinall et al, U.S. Pat. No. 2,759,764; Juvinall, U.S. Pat. No. 2,754,226; Simmons, U.S. Pat. No. 24,602; Wirth U.S. Pat. No. 3,358,931; Hechenbleikner U.S. Pat. No. 1,853,682; and Kent et al, U.S. Pat. No. 3,011,472. Many coating devices are known which are adapted to be driven by fluid motors, such as air motors. See, for example: Sigvardsson et al, U.S. Pat. No. 3,067,949; Wampler et al, U.S. Pat. No. 3,121,024; and Allander, U.S. Pat. No. 2,711,926. The increasing use of such fluid motors is attributable, in part, to the ease with which the rotational speeds of atomizing devices driven by such motors can be varied by varying the fluid pressures in the motors. However, an undesirable characteristic of such fluid motors is that various configurations of atomizing devices used with such motors cause significant variations in the rotational speeds obtainable by the motors.

The air motors which are used to drive such atomizing devices exhibit basically reaction turbine characteristics. That is, the motors utilize the steady-flow principle of fluid acceleration, wherein the fluid-directing nozzles against which the fluid (typically air) accelerates are mounted on the moving driven element of the motor.

According to the present invention, a fluid motor, for the purpose described, exhibits impulse turbine characteristics, i.e., the fluid motor is so constructed that a fluid under pressure enters a stationary nozzle wherein its potential (pressure) energy is converted to kinetic (velocity) energy and absorbed by a rotary element of the fluid motor. Generally, an impulse-type turbine will exhibit lower pressure drop across the turbine in the driving fluid than will a reaction-type turbine capable of obtaining the same r.p.m. under the same load. The driving fluid flows through the motor in a direction away from the atomizing device. Such a motor can be constructed so that parasitic leakage along the fluid motor drive shaft is minimized and disturbances due to such parasitic leakage in the film of coating material on the atomizing device are minimized.

Additionally, according to the invention, a fluid motor is provided which decreases balancing difficulties when the atomizing device driven thereby is replaced by another atomizing device of the same, or a different configuration. Better balance of the turbine-atomizing device system typically results in higher maximum turbine speed and longer turbine life.

Further, according to the invention, a new atomizing device configuration is provided which is capable of handling higher feed rates of high-solids containing liquid coating materials without the necessity of heating such coating materials before they are fed to the atomizing device.

The fluid motor for an atomizing device includes a housing, a shaft for rotatably supporting the atomizing device with respect to the housing, the shaft being rotatably mounted in the housing and including an outer end extending from the housing for mounting the atomizing device. The housing is divided into a high-pressure side and a low-pressure side by a nozzle plate. The nozzle plate defines a plurality of nozzles for directing the flow of driving fluid from the high-pressure side to the low-pressure side. A driven wheel is attached to the shaft and supported for impingement of the driving fluid from the nozzle plate thereagainst. The high-pressure side lies between the shaft outer end and the nozzle plate such that fluid flowing from the high-pressure side through the nozzle plate and past the driven wheel to the low-pressure side flows away from the shaft outer end.

The wheel includes a plurality of peripherally spaced apart, generally radially projecting vanes about the outer periphery thereof. The vanes have curved faces which are generally concave in the direction opposite the direction of driven wheel rotation.

Illustratively, the shaft outer end includes a tapered portion and the atomizing device includes a central aperture for receiving the tapered portion, the central aperture having a tapered side wall conforming to the tapered portion of the shaft.

Additionally, according to the present invention, an atomizing device for attachment to a drive motor output shaft to be spun thereby includes a central portion having a generally outwardly flaring radially inner wall and an outer portion having a flat, generally disk-shaped wall joining the central portion inner wall. The atomizing device further includes a cup for retaining a fluid coating material, the cup having an outwardly flaring inner wall, and the cup being attached to the inner portion. The outward flares of the cup inner wall and central portion inner wall are inverted with respect to one another, the diameter of the cup inner wall being a maximum at its base where it is joined to the central portion inner wall. The cup is provided with a plurality of apertures adjacent its base to provide communication between the cup inner wall and the central portion inner wall. The fluid coating is dispensed on the cup inner wall as the atomizing device is spun and migrates therealong radially outwardly toward the cup base, through the apertures, along the central portion inner wall and the flat wall of the outer portion of the peripheral edge, where the coating material is atomized.

The invention may best be understood by reference to the following description and accompanying drawings which illustrate the invention. In the drawings.

Figure 1:
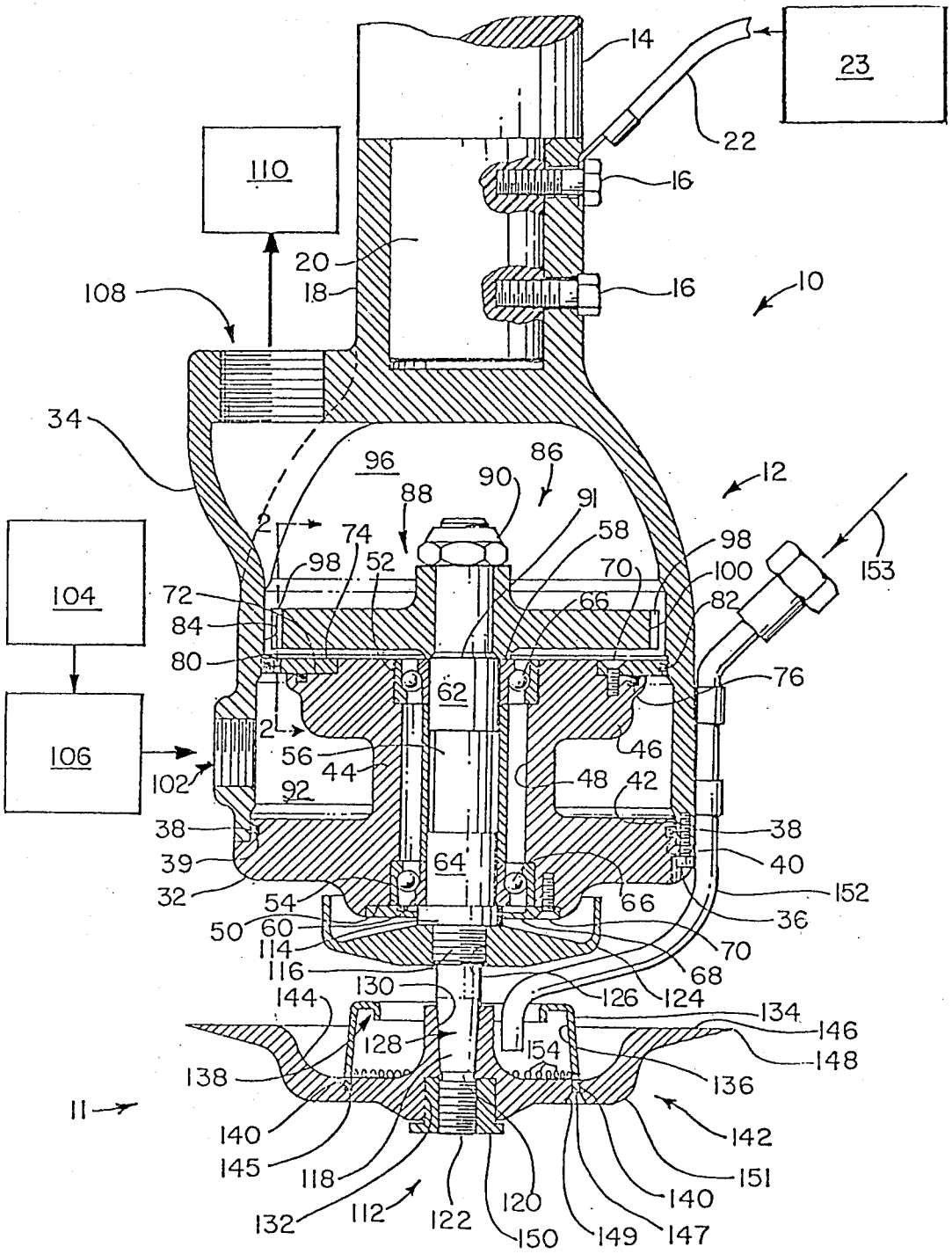
FIG. 1 is a vertical sectional view of a fluid motor and atomizing device arrangement constructed according to the present invention, the arrangement being in a down-feed orientation.

Referring now particularly to FIG. 1, a fluid motor 10 for rotating an atomizing device 11 includes a housing 12 which is, for example, cast aluminum. Housing 12 is supported from an insulating post 14 by bolts 16 which extend through a collar 18 on housing 12 and into the reduced lower end portion 20 of post 14. A lead 22 is attached between the upper bolt 16 and a source of high electrostatic potential 23 (illustrated diagrammatically) to place the fluid motor 10 and atomizing device 11 attached thereto at high electrostatic potential. The supply of electrostatic potential to device 11 allows the particles of coating material dispensed thereby to be electrostatically charged during the atomization and dispensing process to improve the coating efficiency of the atomized particles in accordance with well-known principles.

Housing 12 is divided into a lower, or atomizing device-side, housing portion 32 and an upper, or support means-side, housing portion 34 joined together by a plurality of cap screws 36 (only one of which is shown). An O-ring seal 38 is provided in a groove 39 between adjacent surfaces 40, 42, respectively of housing portions 32, 34 to prevent air in housing 12 from escaping between the upper and lower housing portions. Lower housing portion 32 includes a central cylindrical portion 44 supporting an upper annular portion 46. A bore 48 extends longitudinally through the cylindrical portion 44 and annular portion 46 from inside housing portion 34 to the bottom surface 50 of lower portion 32. Bore 48 is provided with bearing races 52, 54 adjacent its upper and lower ends, respectively.

A motor shaft 56 extends longitudinally through bore 48. Upper and lower bearing races 58, 60, respectively, are press-fitted onto enlarged diameter portions 62, 64, respectively, of shaft 56. Suitable bearings 66 in races 52, 58 and 54, 60 support shaft 56 for rotation in housing 12. The lower end of shaft 56 is located in housing portion 32 by a locating disk 68 which holds lower outer race 54 in position in housing portion 32. Disk 68 is held in place by a plurality of screws 70 (only one of which is shown) which extend through countersunk bores in locating disk 68 and mating threaded bores in surface 50 of housing portion 32.

The upper annular portion 46 of housing portion 32 includes an upwardly and outwardly facing annular groove 72. A flat annular nozzle plate 74 is mounted in groove 72 by a plurality of screws 70 which extend through countersunk bores in nozzle plate 74 and mating threaded bores in groove 72. An annular groove 76 extends about annular portion 46 in the bottom surface 78 of groove 72. Groove 76 carries a sealing ring which prevents leakage of compressed air between nozzle plate 74 and annular portion 46.

Nozzle plate 74 is provided with a plurality of apertures of nozzles 80 (see FIG. 2) about the periphery thereof. The illustrative nozzle plate 74 includes six peripherally equally spaced nozzles 80, only one of which is illustrated in FIG. 1. The nozzle plate 74 also contains an outwardly opening groove 82 in which is located an O-ring seal which seals the outer periphery of nozzle plate 74 to the inner side wall 84 of upper housing portion 34 to prevent leakage of compressed air therebetween.

The inner or upper end 86 of shaft 56 is threaded. A driven turbine wheel 88 is placed on shaft 56 directly beneath the threaded end 86 thereof. A nut 90 threaded on end 86 secures turbine wheel 88 against axial movement on shaft 56. Nut 90 tightens turbine wheel 88 against a bevel 91 on enlarged portion 62 of shaft 56. A mating bevel 93 is provided on wheel 88.

Housing 12 is divided into a lower, high-pressure or intake side 92 and an upper, low-pressure or exhaust side 96 by nozzle plate 74. Turbine wheel 88 includes a plurality of generally radially extending vanes 98 (see FIG. 2) about the outer periphery 100 thereof. Vanes 98 are in the path of compressed air flow through nozzles 80 between high-pressure side 92 and low-pressure side 96. As the compressed air expands through nozzles 80 from the high-pressure side 92 to the low-pressure side 96, this air reacts against vanes 98, causing turbine wheel 88 and motor shaft 56 to spin. The described fluid motor 10, including stationary nozzles in which the potential energy of high-pressure air is converted to the kinetic energy of moving air velocity, which kinetic energy is absorbed by driven wheel 88, is characteristic of a type of turbine known as an impulse turbine. This type is used in contrast to a reaction-type turbine, i.e., one in which the steady-flow principle of fluid acceleration is utilized. Typically, reaction-type turbines are characterized in that the fluid flow-directing nozzles are mounted on the moving element. A significant advantage of the use of an impulse-type turbine over a reaction-type turbine in the instant application is that an impulse-type turbine typically will operate efficiently with a lower pressure differential across the driven element (wheel 88). For example, in the illustrative fluid motor 10 a high-pressure side 92 pressure of 64.7 p.s.i.a. to 34.7 p.s.i.a., variable to adjust the wheel 88 r.p.m., and a low-pressure side 96 pressure of 14.7 p.s.i.a. provide satisfactory results.

An air inlet 102 is provided in upper housing portion 34 to supply air from a source 104 of compressed air (illustrated diagrammatically) through a regulator 106 to high-pressure side 92. Regulator 106 controls the air pressure in high-pressure side 92, thereby controlling the pressure differential between high-pressure side 92 and low-pressure side 96 and the r.p.m. of turbine wheel 88.

An exhaust port 108 is provided in housing portion 34 to exhaust from low-pressure side 96 air which has already passed through nozzle plate 74 and wheel 88. Air is exhausted to atmosphere through a muffler 110, also illustrated diagrammatically.

This particular arrangement, with the high-pressure side 92 between the output end 112 of motor shaft 56 and the nozzle plate 74, provides a flow of compressed air in a general direction away from the output end 112 of shaft 56. This configuration is desirable in that parasitic air leakage from the fluid motor 10 toward the output end 112 of shaft 56 will be less likely. Such parasitic leakage is to be avoided since disturbance of the air at output end 112 increases the likelihood of disturbance of the film of coating material on atomizing device 11.

The output end 112 of shaft 56 includes an enlarged spacer portion 114 against which race 60 rests, a larger diameter threaded portion 116, a frustoconical or straight-tapered portion 118, an annular groove 120 and a reduced diameter threaded portion 122.

A cup-shaped slinger 124 having a central threaded aperture 126 is threaded onto portion 116 of shaft end 112. Slinger 124 is tightened against spacer 114. Slinger 124 prevents coating material, e.g., paint, from migrating upwardly along shaft 56 from atomizing device 11 and fouling the lower bearings 60 of motor 10.

Device 11 includes a central bore 128 having a tapered portion 130 and an enlarged diameter circular portion 132. The taper of portion 130 matches the taper of portion 118 of shaft 56. These matching tapers provide ease of assembly of atomizing device 11 onto the shaft 56 and minimize the possibility of misalignment of device 11 on the shaft, and the resultant imbalance. These matching tapers 118, 130 allow device 11 to be replaced quickly and easily by another atomizing device of the same or a different type without the need for critical and time-consuming balancing procedures.

Device 11 includes a central paint cup 134 having a gradually flaring inside wall 136, the diameter of which increases from top to bottom. Cup 134 also includes an overhanging lip 138 on its end adjacent bottom surface 50 of fluid motor 10. The flaring surface 136 is provided so that centrifugal force will carry coating material dispensed into cup 134 toward apertures 154, hereinafter described. Lip 138 prevents coating material dispensed into cup 134 from exiting out of the top of the cup. Cup 134 is provided with a right circular cylindrical portion 140 at the bottom thereof.

Atomizing device 11 further includes a generally cup- or bell-shaped central portion 142 having a gradually upwardly and outwardly flaring inside surface 144. Surface 144 flares outwardly to join a flat, radially outer annular surface 146, from the edge 148 of which the coating material to be dispensed is atomized.

Central portion 142 includes a right circular cylindrical groove 145 which receives the right circular cylindrical portion 140 of paint cup 134. Paint cup 134 is secured in groove 145, e.g., by spot welding at several points 147 through countersunk bores 149 on the underside 151 of device 11.

Device 11 is held on motor shaft 56 by a nut 150 which is threaded on the reduced diameter threaded portion 122 of shaft output end 112.

In operation, compressed air is supplied to the high-pressure side 92 of fluid motor 10. The flow of compressed air through nozzles 80 and past driven wheel 88 to the low-pressue side 96 of motor 10 spins shaft 56 and atomizing device 11 at a speed determined by the pressure differential across nozzle plate 74. As previously mentioned, this differential can be varied by varying the pressure difference between the pressure in the side 92 and the pressure in side 96 by adjusting regulator 106. As device 11 spins, fluid coating material, e.g., high-solids paint, is supplied through a paint tube 152 to the interior of paint cup 134 in the direction indicated by arrow 153. Paint tube 152 is attached to the motor housing 12.

Paint dispensed from paint tube 152 is moved along side wall 136 toward the outer end of paint cup 134 due, in part, to centrifugal force. The paint is dispensed through several small apertures 154 in wall 136 at the level of surface 144. In a device constructed according to the present invention, ninety such apertures 154 were provided, the apertures being equally spaced about the periphery of wall 136. The paint passes through apertures 154 and is forced outwardly and upwardly along surface 144 to suface 146. The distributed paint forms a smooth, even layer on sufaces 144, 146 and is atomized at the edge 148 as it is thrown off device 11. If an electrostatic power supply 23 is used, all of the conductive components of motor 10 and device 11 carry electrostatic charge. This charge also appears on the atomized particles of paint dispensed from edge 148.

Figure 2:
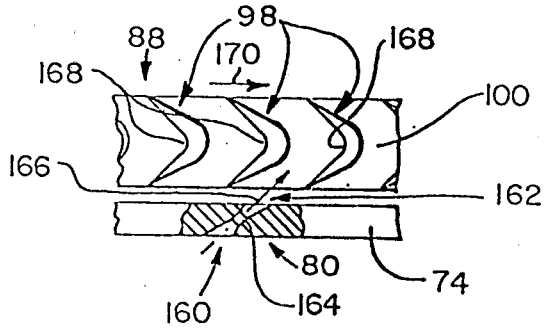
FIG. 2 is a partly fragmentary sectional view taken generally along section lines 2—2 of FIG. 1.

FIG. 2 illustrates in greater detail the configuration of nozzles 80 and vanes 98 of the nozzle plate 74 and turbine wheel 88, respectively. Each nozzle 80 is formed in a dual inverted cone configuration, the frustoconical sections 160, 162 of which are joined near their apices by a straight throat 164 having a right circular cylindrical cross section. Air flows through the nozzle 80 in the direction indicated by arrow 166. As the air expands in the nozzle portion 162 of nozzle 80 and impinges against the cup- or bucket-shaped faces 168 of vanes 98, the turbine wheel 88 turns in the direction of arrow 170.

Figure 3:
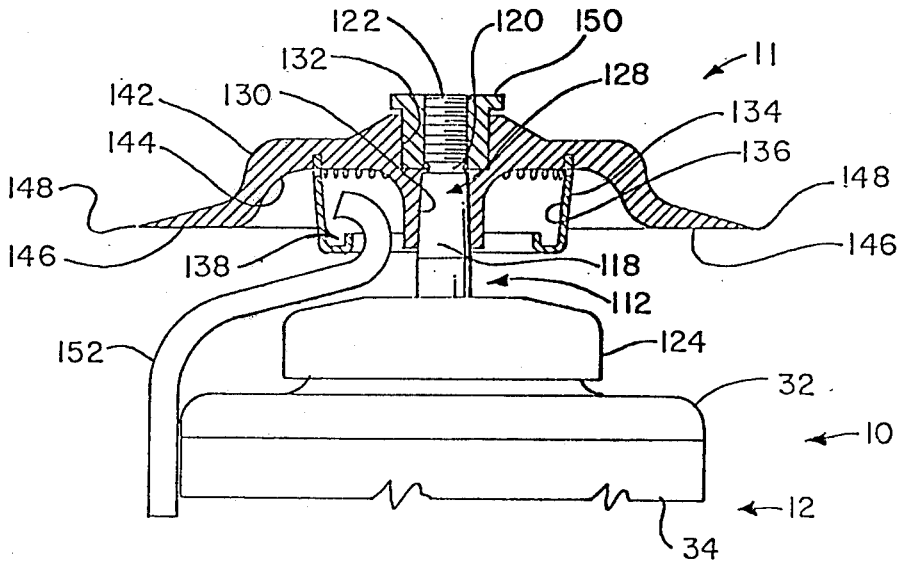
FIG. 3 is a fragmentary vertical sectional view of a fluid motor and atomizing device of the type illustrated in FIG. 1, in an up-feed orientation.

The device as described thus far is a down-feed system in which the coating material is fed down into the paint cup 134. Of course, the apparatus of the instant invention is useful with an up-feed type system illustrated in FIG. 3. In the system of FIG. 3, the paint tube 152 end is formed to direct the paint over the lip 138 of the paint cup 134. In this embodiment, those elements numbered identically with the elements of FIG. 1 perform the same or similar functions.

Figure 4:
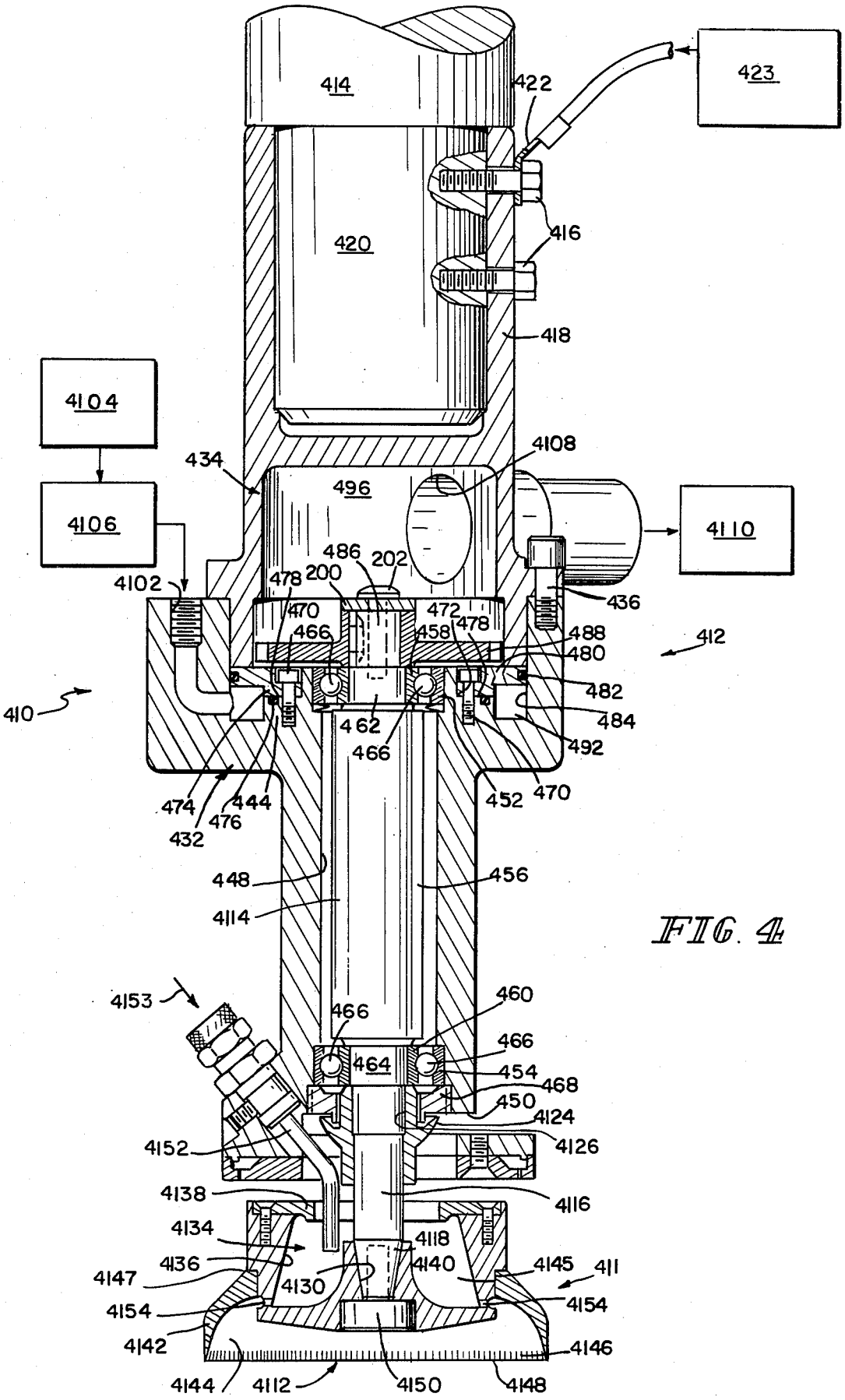
FIG. 4 is a vertical sectional view of a fluid motor and atomizing device arrangement constructed according to the present invention, in a down-feed orientation.
Figure 5:
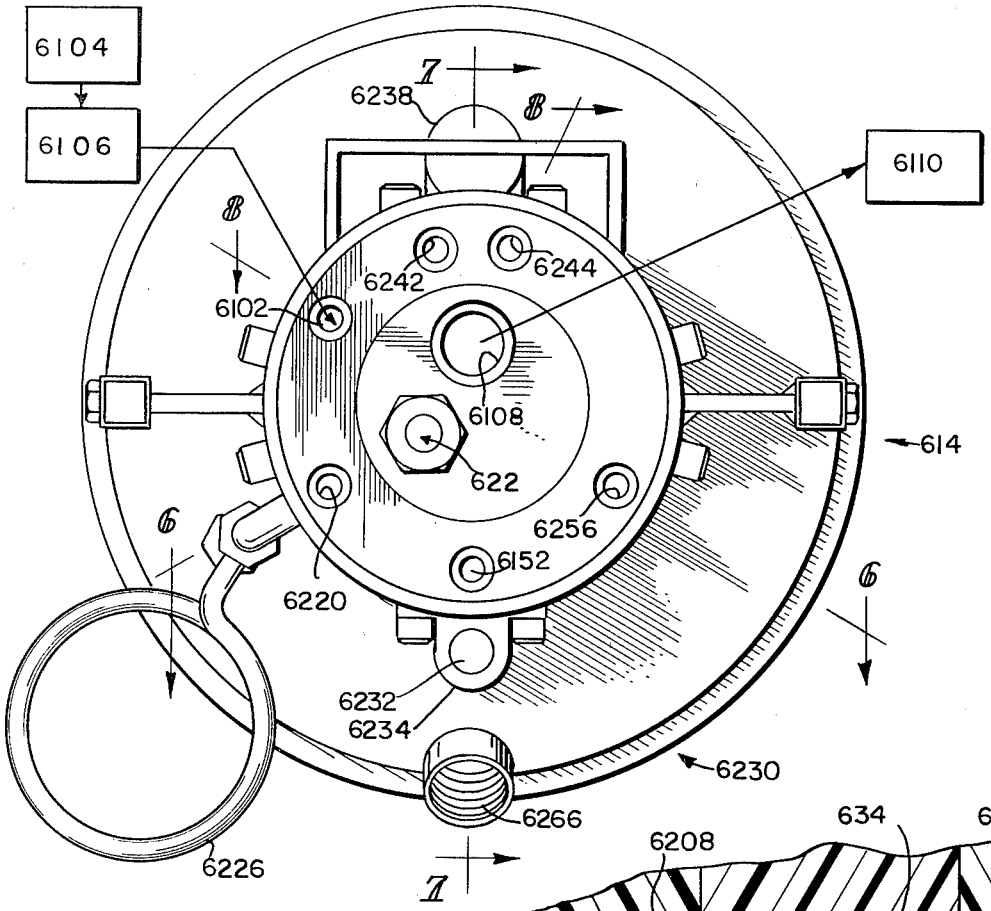
FIG. 5 is a top plan view of a fluid motor and atomizing device arrangement constructed according to the present invention, in a down-feed orientation.
Figure 8:
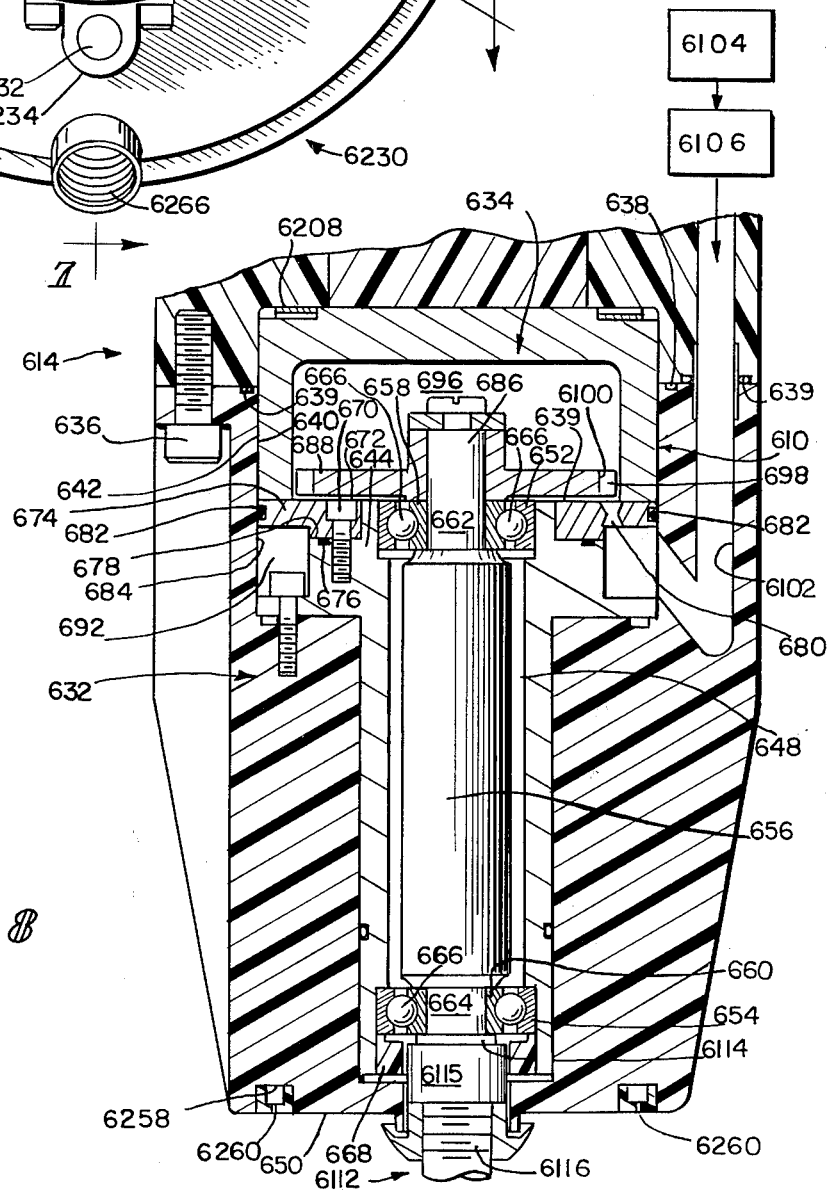
FIG. 8 is a partly fragmentary vertical sectional view of the apparatus of FIGS. 5-7, taken generally along section lines 8—8 of FIG. 5.
Figure 6:
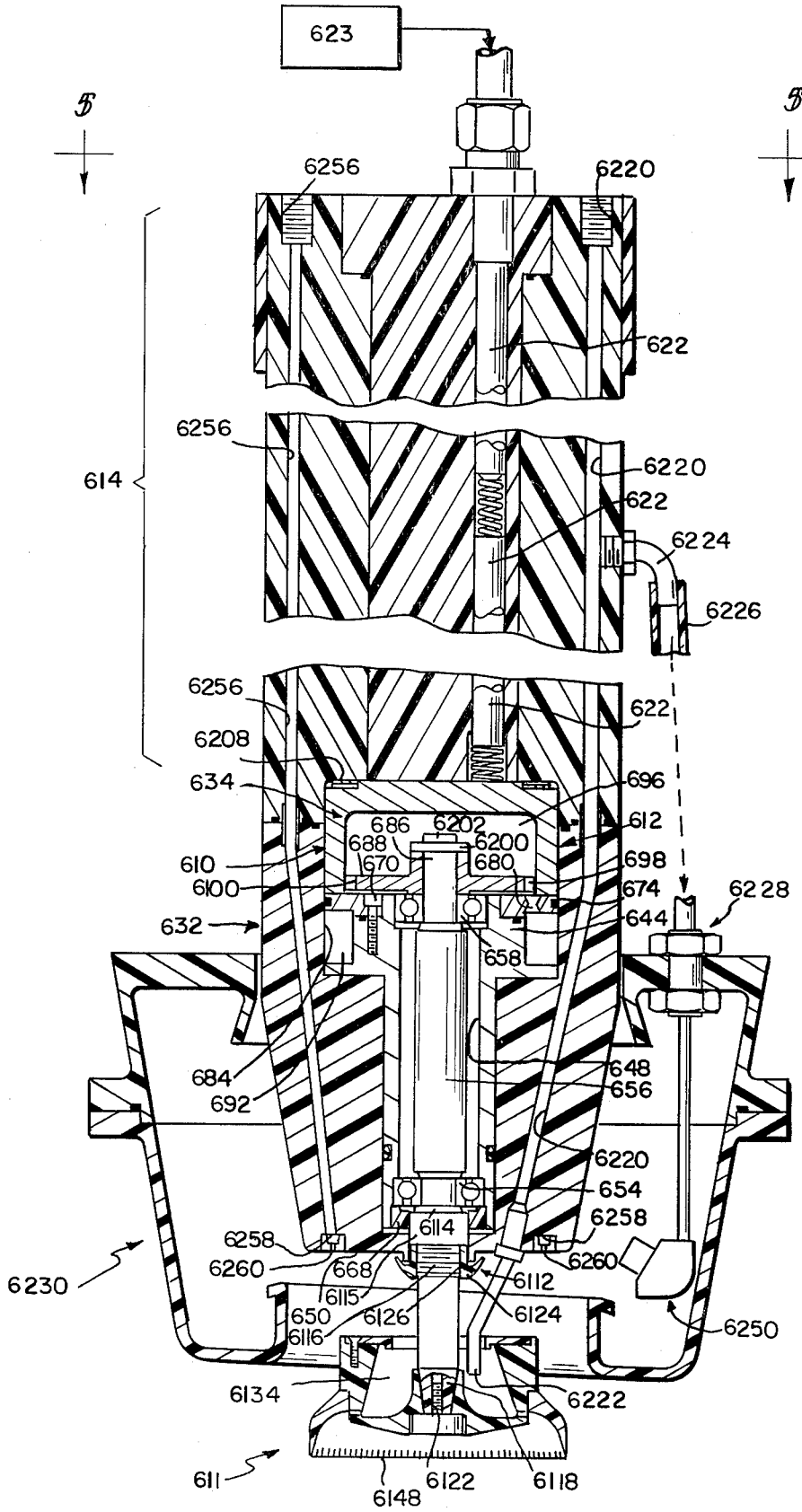
FIG. 6 is a partly fragmentary vertical sectional view of the apparatus of FIG. 5, taken generally along section lines 6—6 of FIG. 5.

Referring to FIG. 4, a fluid motor 410 for rotating an atomizing device 411 includes a housing 412 which is, for example, cast aluminum. Housing 412 is supported from an insulating post 414 by bolts 416 which extend through a collar 418 on housing 412 and into the reduced lower end portion 420 of post 414. A lead 422 is attached between the upper bolt 416 and a source of high electrostatic potential 423 (illustrated diagrammatically) to place the fluid motor 410 and atomizing device 411 attached thereto at high electrostatic potential.

The supply of electrostatic potential to device 411 allows the particles of coating material dispensed thereby to be electrostatically charged during the atomization and dispensing process to improve the coating efficiency of the atomized particles in accordance with well-known principles.

Housing 412 is divided into a lower, or atomizing device-side, housing portion 432 and an upper, or support means-side, housing portion 434 joined together by a plurality of cap screws 436 (only one of which is shown). Lower housing portion 432 includes a central cylindrical portion 444. A bore 448 extends longitudinally through the cylindrical portion 444 from inside housing 412 to the bottom surface 450 of lower portion 432. Bore 448 is provided with bearing races 452, 454 adjacent its upper and lower ends, respectively.

A motor shaft 456 extends longitudinally through bore 448. Upper and lower bearing races 458, 460, respectively, are press-fitted onto portions 462, 464, respectively, of shaft 456. Suitable bearings 466 in races 452, 458 and 454, 460 support shaft 456 for rotation in housing 412. The lower end of shaft 456 is located in housing portion 432 by a locating disk 468 which holds lower outer race 454 in position in housing portion 432. Disk 468 is threaded into the lower end of housing portion 432.

The upper end of housing portion 432 includes an upwardly and outwardly facing annular groove 472. An annular nozzle plate 474 is mounted in groove 472 by a plurality of screws 470 which extend through countersunk bores in nozzle plate 474 and mating threaded ɔores in groove 472. An annular groove 476 extends ıbout cylindrical portion 444 in the bottom surface 478 ɔf groove 472. Groove 476 carries a sealing ring which ɔrevents leakage of compressed air between nozzle ɔlate 474 and cylindrical portion 444.

Nozzle plate 474 is provided with one aperture or ıozzle 80 (see FIG. 2) at its periphery. The nozzle plate 474 also contains an outwardly opening groove 482 in which is located an O-ring seal which seals the outer ɔeriphery of nozzle plate 474 to the inner side wall 484 ɔf lower housing portion 432 to prevent leakage of ɔompressed air therebetween.

The inner or upper end 486 of shaft 456 is internally hreaded. A driven turbine wheel 488 is placed on the nner end 486 of shaft 456. A washer 200 and screw 202 ıecure turbine wheel 488 against axial movement on haft 456. Screw 202 tightens turbine wheel 488 against he inner race 458 on shaft 456.

Housing 412 is divided into a lower, high-pressure or ntake side 492 and an upper, low-pressure or exhaust ide 496 by nozzle plate 474. Turbine wheel 488 in-ɔludes a plurality of generally radially extending vanes 98 (see FIG. 2) about the outer periphery 4100 thereof. Vanes 98 are in the path of compressed air flow through ıozzles 80 between high-pressure side 492 and low-ɔressure side 496. As the compressed air expands hrough nozzles 80 from the high-pressure side 492 to he low-pressure side 496, this air reacts against vanes 98, causing turbine wheel 488 and motor shaft 456 to pin. The fluid motor 410 of this embodiment, including tationary nozzles in which the potential energy of ıigh-pressure air is converted to the kinetic energy of ıoving air velocity, which kinetic energy is absorbed y driven wheel 488, also is characteristic of an impulse ırbine. Again, an impulse turbine is used in contrast to reaction-type turbine, i.e., one in which the steady-low principle of fluid acceleration is utilized. Typi-ally, reaction-type turbines are characterized in that he fluid flow-directing nozzles are mounted on the ıoving element. A significant advantage of the use of n impulse-type turbine over a reaction-type turbine in ıe instant application is that an impulse-type turbine ypically will operate efficiently with a lower pressure ifferential across the driven element (wheel 488). In ıe fluid motor 410 of FIG. 4, a high-pressure side 492 ressure of 64.7 p.s.i.a. to 34.7 p.s.i.a., variable to adjust ıe wheel 488 r.p.m., and a low-pressure side 496 pres-ıre of 14.7 p.s.i.a. provide satisfactory results.

An air inlet 4102 is provided in lower housing portion 32 to supply air from a source 4104 of compressed air llustrated diagrammatically) through a regulator 4106 ɔ high-pressure side 492. Regulator 4106 controls the ır pressure in high-pressure side 492, thereby control-ng the pressure differential between high-pressure side 92 and low-pressure side 496 and the r.p.m. of turbine heel 488.

An exhaust port 4108 is provided in housing portion 34 to exhaust from low-pressure side 496 air which has ready passed through nozzle plate 474 and wheel 488. ır is exhausted to atmosphere through a muffler 4110, so illustrated diagrammatically.

As with the embodiment of FIGS. 1–3, this arrange-ent, with the high-pressure side 492 between the out-ıt end 4112 of motor shaft 456 and the nozzle plate 74, provides a flow of compressed air in a general rection away from the output end 4112 of shaft 456. his configuration is desirable in that parasitic air leak-ge from the fluid motor 410 toward the output end 4112 of shaft 456 will be less likely. Such parasitic leakage is to be avoided since disturbance of the air at output end 4112 increases the likelihood of disturbance of the film of coating material on atomizing device 411.

The shaft 456 includes an enlarged spacer portion 4114 against which race 460 rests, a smooth cylindrical portion 4116, and a frustoconical or straight-tapered portion 4118.

A cup-shaped slinger 4124 having a central threaded aperture 4126 is mounted on portion 4116. Slinger 4124 prevents coating material, e.g., paint, from migrating upwardly along shaft 456 from atomizing device 411 and fouling the lower bearings 460 of motor 410.

Device 411 includes a tapered central bore 4130. The taper of portion 4130 matches the taper of portion 4118 of shaft 456. These matching tapers facilitate mounting of atomizing device 411 on the shaft 456 and minimize the possibility of misalignment of device 411 on the shaft, and the resultant imbalance. These matching tapers 4118, 4130 allow device 411 to be replaced quickly and easily by another atomizing device of the same or a different type without the need for critical and time-consuming balancing procedures.

Device 411 includes a central paint cup 4134 with inside wall 4136 which flares outwardly at about 15° from vertical from top to bottom. Cup 4134 also includes an overhanging lip 4138 on its end adjacent bottom surface 450 of fluid motor 410. The flaring surface 4136 is provided so that centrifugal force will carry coating material dispensed into cup 4134 toward apertures 4154, hereinafter described. Lip 4138 prevents coating material dispensed into cup 4134 from exiting out of the top of the cup.

Atomizing device 411 further includes a generally cup- or bell-shaped outer portion 4142 having a gradually downwardly and outwardly flaring inside surface 4144. Surface 4144 flares outwardly to a region 4146, from the edge 4148 of which the coating material to be dispensed is atomized. Region 4146 includes a series of radially and axially extending grooves, the construction and purpose of which is described in U.S. Pat. No. 4,148,932, issued Apr. 10, 1979.

Paint cup 4134 includes a right circular cylindrical groove 4145 which receives a right circular cylindrical portion 4140 of portion 4142. Portion 4142 is secured to paint cup portion 4134, e.g., by spot welding at several points 4147 around the outsides of portions 4134, 4142.

Device 411 is held on motor shaft 456 by a nut 4150 which is threaded into a bore in portion 4118 of shaft output end 4112.

In operation, compressed air is supplied to the high-pressure side 492 of fluid motor 410. The flow of compressed air through nozzles 480 and past driven wheel 488 to the low-pressure side 496 of motor 410 spins shaft 456 and atomizing device 411 at a speed determined by the pressure differential across nozzle plate 474. As previously mentioned, this differential can be varied by varying the pressure difference between the pressure in the side 492 and the pressure in side 496 by adjusting regulator 4106. As device 411 spins, fluid coating material, e.g., high-solids paint, is supplied through a paint tube 4152 to the interior of paint cup 4134 in the direction indicated by arrow 4153. Paint tube 4152 is attached to the motor housing 412.

Paint dispensed from paint tube 4152 is moved along side wall 4136 toward the lower end of paint cup 4134 due, in part, to centrifugal force. The paint is dispensed through the several small apertures 4154 in wall 4136 at the level of surface 4144. In a device constructed according to the present invention, sixty such apertures 4154 were provided, the apertures being equally spaced about the periphery of wall 4136. The paint passes through apertures 4154, outwardly and downwardly along surface 4144 to surface 4146. The distributed paint forms a smooth, even layer on surface 4144, 4146 and is atomized at the edge 4148 as it is thrown off device 411. If an electrostatic power supply 423 is used, all of the conductive components of motor 410 and device 411 carry electrostatic charge. This charge also appears on the atomized particles of paint dispensed from edge 4148.

Referring now to FIGS. 5–8, a fluid motor 610 for rotating an atomizing device 611 (FIGS. 6–7) includes a housing 612 which is constructed partly from cast aluminum and partly from a filled synthetic resin. Housing 612 is molded into a synthetic resin insulating post 614 through which are provided all necessary services to the motor and atomizing device. A lead 622 (FIG. 6) couples the conductive components of motor 610 and device 611 to a source of high electrostatic potential 623 (illustrated diagrammatically) to place the fluid motor 610 metal components and atomizing device 611 at high electrostatic potential. The supply of electrostatic potential to device 611 allows the particles of coating material dispensed thereby to be electrostatically charged during the atomization and dispensing process to improve the coating efficiency of the atomized particles in accordance with well-known principles.

Housing 612 is divided into a lower, or atomizing device-side, housing portion 632 constructed largely from synthetic resin and an upper, or support means-side, housing portion 634 secured together by a plurality of cap screws 636 (FIG. 8), only one of which is shown. O-ring seals 638 ar provided in grooves 639 to prevent high pressure air leakage from between adjacent surfaces 640, 642, respectively, of housing portion 632, 634 to prevent air in housing 612 from escaping between the upper and lower housing portions. See FIG. 8. Lower housing portion 632 includes a central cylindrical portion 644. A bore 648 extends longitudinally through the cylindrical portion 644 from inside housing portion 634 to the bottom surface 650 of lower portion 632. Bore 648 is provided with bearing races 652, 654 adjacent its upper and lower ends, respectively.

A motor shaft 656 extends longitudinally through bore 648. Upper and lower bearing races 658, 660, respectively, are press-fitted onto portions 662, 664, respectively, of shaft 656. Suitable bearings 666 in races 652, 658 and 654, 660 support shaft 656 for rotation in housing 612. The lower end of shaft 656 is located in housing portion 632 by a locating ring 668 which holds lower outer race 654 in position in housing portion 632. Ring 668 is threaded into housing portion 632.

The upper end of housing portion 632 includes an upwardly and outwardly facing annular groove 672. An annular nozzle plate 674 is mounted in groove 672 by a plurality of screws 670 which extend through countersunk bores in nozzle plate 674 and mating threaded bores in groove 672. An annular groove 676 extends about cylindrical portion 644 in the bottom surface 678 of groove 672. Groove 676 carries a sealing ring which prevents leakage of compressed air between nozzle plate 674 and cylindrical portion 644.

Nozzle plate 674 is provided with one aperture or nozzle 80 (see FIG. 2) at its periphery. The nozzle plate 674 also contains an outwardly opening groove 682 in which is located an O-ring seal which seals the outer periphery of nozzle plate 674 to the inner side wall 684 of lower housing portion 632 to prevent leakage of compressed air therebetween.

The inner or upper end 686 of shaft 656 is internally threaded. A driven turbine wheel 688 is placed on the inner end 686 of shaft 656. A washer 6200 and screw 6202 secure turbine wheel 688 against axial movement on shaft 656. Screw 6202 tightens turbine wheel 688 against the inner race 658 on enlarged portion 662 of shaft 656.

Housing 612 is divided into a lower, high-pressure or intake side 692 and an upper, low-pressure or exhaust side 696 by nozzle plate 674. Turbine wheel 688 includes a plurality of generally radially extending vanes 98 (see FIG. 2) about the outer periphery 6100 thereof. Vanes 698 are in the path of compressed air flow through nozzles 80 between high-pressure side 692 and low-pressure side 696. As the compressed air expands through nozzles 80 from the high-pressure side 692 to the low-pressure side 696, this air reacts against vanes 98, causing turbine wheel 688 and motor shaft 656 to spin. The fluid motor 610 of this embodiment, including stationary nozzles in which the potential energy of high-pressure air is converted to the kinetic energy of moving air velocity, which kinetic energy is absorbed by driven wheel 688, is also an impulse turbine. Again, a significant advantage of the use of an impulse-type turbine over a reaction-type turbine in the instant application is that an impulse-type turbine typically will operate efficiently with a lower pressure differential across the driven element (wheel 688). For example, in the fluid motor 610 of FIGS. 5–8, a high-pressure side 692 pressure of 64.7 p.s.i.a. to 34.7 p.s.i.a., variable to adjust the wheel 688 r.p.m., and a low-pressure side 696 pressure of 14.7 p.s.i.a. provide satisfactory results.

An air inlet 6102 is provided in lower housing portion 632 to supply air from a source 6104 of compressed air (illustrated diagrammatically) through a regulator 6106 to high-pressure side 692. Regulator 6106 controls the air pressure in high-pressure side 692, thereby controlling the pressure differential between high-pressure side 692 and low-pressure side 696 and the r.p.m. of turbine wheel 688.

An exhaust port 6108 is provided in housing portion 634 to exhaust from low-pressure side 696 air which has already passed through nozzle plate 674 and wheel 688. Air is exhausted to atmosphere through a muffler 6110, also illustrated diagrammatically.

This particular arrangement, with the high-pressure side 692 between the output end 6112 of motor shaft 656 and the nozzle plate 674, provides a flow of compressed air in a general direction away from the output end 6112 of shaft 656. This configuration is desirable in that parasitic air leakage from the fluid motor 610 toward the output end 6112 of shaft 656 will be less likely. Such parasitic leakage is to be avoided since disturbance of the air at output end 6112 increases the likelihood of disturbance of the film of coating material on atomizing device 611. Also, movement of air along bore 648 toward end 6112 could carry grease from the bearings 666 to the coating material. This is to be avoided.

The output end 6112 of shaft 656 includes an enlarged spacer portion 6114 against which race 660 rests, a larger diameter portion 6115, a threaded portion 6116, and a sraight-tapered portion 6118, with an internally threaded bore 6122.

A cup-shaped slinger 6124 having a central threaded aperture 6126 is threaded onto portion 6116 of shaft end 6112. Slinger 6124 is tightened against portion 6115. Slinger 6124 prevents coating material, e.g., paint, from migrating upwardly along shaft 656 from atomizing device 611 and fouling the lower bearings 660 of motor 610. Device 611 is as described in connection with the embodiment of FIG. 4.

In the embodiment of FIGS. 5–8, additional services are provided through the insulating post 614 and the lower motor housing portion 632 for the rotating atomizing device 611. Specifically, and with reference to FIGS. 5, 6, solvent delivery passageways 6220 are formed in the post 614 and motor housing portion 632 for delivery of a solvent to the interior of the paint cup 6134 of device 611 through a solvent tube 6222. A fitting 6224 provides access into the passageway 6220 along the side of column 614, and an additional flexible coiled solvent delivery line 6226 extends from tap 6224 to a fitting 6228 on a cleaning shroud 6230.

Figure 7:
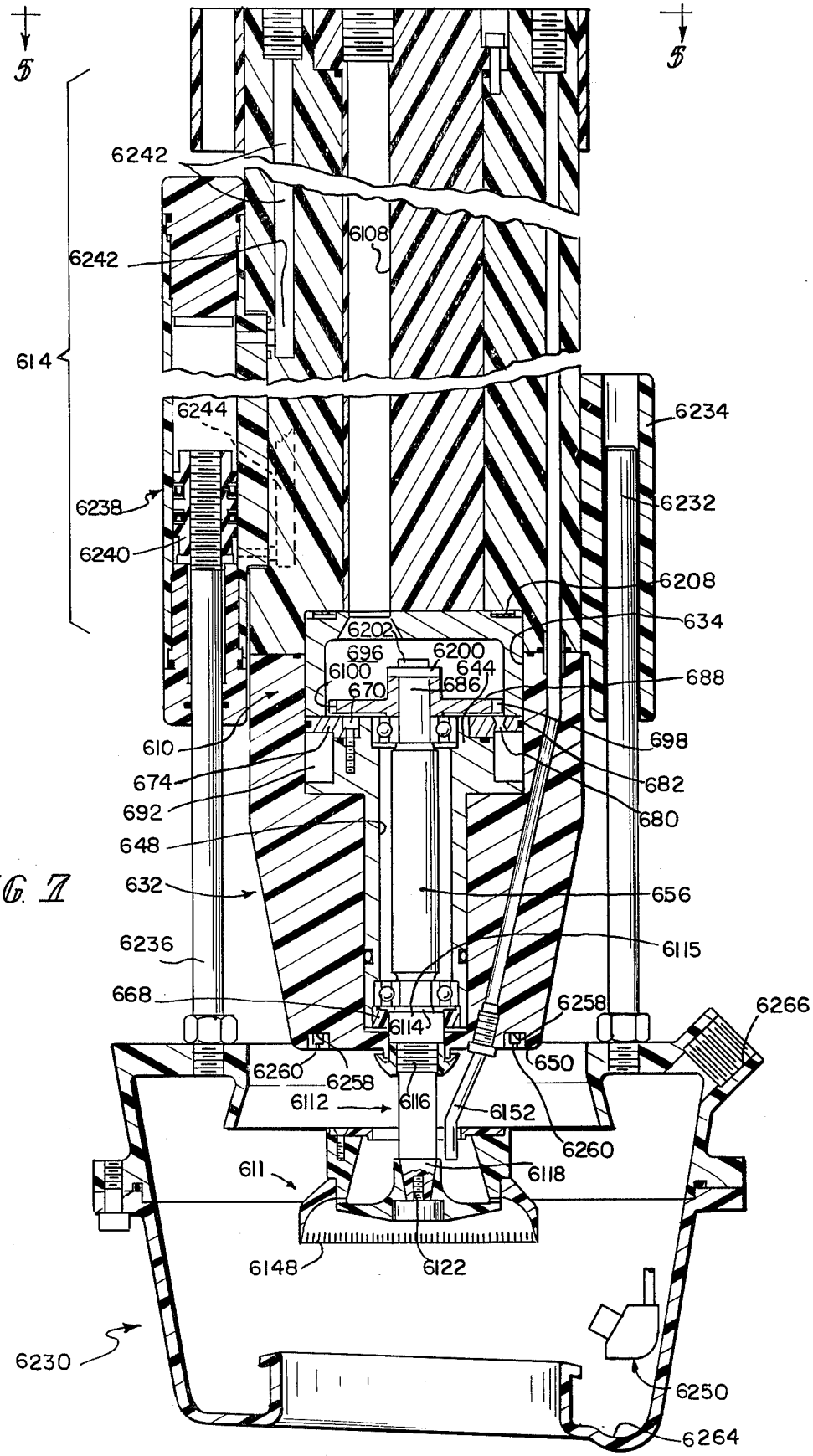
FIG. 7 is a partly fragmentary vertical sectional view of the apparatus of FIGS. 5-6, taken generally along section lines 7—7 of FIG. 5.

Shroud 6230 is mounted from post 6232 and bushing 6234 for reciprocating movement relative to device 611. See FIG. 7. Such reciprocating movement is achieved by a piston rod 6236, a cylinder 6238, and a double-acting piston 6240 mounted along the side of the column 614. Shroud 6230 projecting- and retracting-air services are provided through passageways 6242, 6244, respectively, which extend along the length of column 614. The shroud 6230 is projected after a coating operation is completed, e.g., during a change in the color of the paint to be delivered through tube 6152 while solvent is being dispensed through 6220, 6222, 6224, 6226 (FIG. 7). A flushing nozzle 6250 is disposed within shroud 6230 and is connected to fitting 6228. When shroud 6230 is in its extended position, illustrated in FIG. 7, solvent is supplied through 6220, 6224, 6226 and fitting 6228 to the nozzle 6250. A stream of solvent is directed into the rotating atomizing device 611 to rinse any paint residue from device 611.

An additional service, shaping air, is provided through a passageway 6256 (FIGS. 5–6) which extends along the column 614. Shaping air is delivered through passageway 6256 to shape the atomized and electrostatically charged paint particles as they are dispensed from edge 6148 of atomizing device 611. This shaping air is delivered through an annular channel 6258 to a series of holes 6250 at the end of motor housing portion 632.

Shroud 6230 is shaped to provide a well portion 6264 (FIG. 7) toward which all liquid solvent, etc., in the shroud flows. A threaded bore 6266 is provided in the shroud to support a siphon (not shown) which extends down to the well 6264 to evacuate such solvent, etc., from the shroud.

As with the device in FIGS. 1–3, the device of FIG. and the device of FIGS. 5–8, although presented in down-feed configurations, are readily adaptable to up-feed type systems or side-feed type systems.

In the embodiment of FIGS. 1–3, the number of nozzles can be varied from one to twenty-four, as required for the horsepower and air consumption requirements for a particular application. In the embodiments of FIGS. 4–8, the number of nozzles can be varied from one to fifteen according to horsepower and air consumption requirements.

What is claimed is:

1. A fluid motor for an atomizing device, the motor including a housing, a shaft for rotatably supporting the atomizing device with respect to the housing, means for supporting the housing from a side thereof remote from the atomizing device, the shaft being rotatably mounted in the housing and including an outer end extending from the housing for mounting the atomizing device, means for defining within the housing a high-pressure side and a low-pressure side and for providing at least one fluid nozzle directing a flow of a driving fluid from the high-pressure side to the low-pressure side, and a driven wheel attached to the shaft for impingement of the driving fluid from the nozzle thereagainst, the high-pressure side located between the shaft outer end and the nozzle-providing means such that fluid flowing from the high-pressure side through the nozzle-providing means and the driven wheel to the low-pressure side flows away from the shaft outer end, the housing being divided into an atomizing device-side portion and a support means side portion, the atomizing device-side portion including means for providing a bore for rotatably mounting the shaft, the bore-providing means including a pedestal-like support portion extending longitudinally with the bore and having an end attached to a surrounding portion of the atomizing device-side portion and projecting away from the surrounding portion of the atomizing device-side portion to provide a distal end, the shaft outer end extending from the housing through the atomizing device-side portion, and the nozzle-providing means including a nozzle plate, means for sealably attaching the nozzle plate to the distal end of the pedestal-like support and means for sealingly engaging an inner wall of the housing to divide it into said low- and high-pressure sides, the shaft projecting beyond the distal end of the pedestal-like support into the low-pressure side of the housing and the driven wheel being mounted on said shaft projecting portion in closely spaced relation to the nozzle plate.

2. A fluid motor for an atomizing device, the motor including a housing, a shaft for rotatably supporting the atomizing device with respect to the housing, the shaft being rotatably mounted in the housing and including an outer end extending from the housing for mounting the atomizing device, the housing including means for mounting the motor from a support, the motor having a high-pressure side, a low-pressure side, a nozzle plate for directing a flow of a driving fluid from the high-pressure side to the low-pressure side, and a driven wheel attached to the shaft for impingement of the driving fluid from the nozzle plate thereagainst, the housing being divided into an atomizing device-side portion and a mounting means-side portion, the atomizing device side portion including a pedestal-like portion projecting generally toward the mounting means side portion, the pedestal-like portion having a distal end, the distal end including means for sealably attaching the nozzle plate thereto, the pedestal-like portion including means providing a bore for rotatably retaining the shaft, the atomizing device side portion and nozzle plate defining the high-pressure side of the motor and the mounting means-side portion and nozzle plate defining the low-pressure side of the motor, and the nozzle plate including means sealably engaging an inner wall of the housing, the shaft including an inner end within the housing and protruding from the bore on the low-pressure side, the driven wheel mounted on the shaft inner end, the shaft outer end including a tapered portion and the atomizing device including a central aperture for receiving the tapered portion, the central aperture having a tapered side wall conforming to the tapered portion of the shaft.

3. In combination, an atomizing device for coating material, a fluid motor for rotating the atomizing device, and means for supporting the motor, the motor including a housing, a shaft including an inner end within the motor housing and outer end protruding from the motor housing for mounting the atomizing device on the shaft, a wheel mounted on the shaft inner end, the wheel including a plurality of peripherally spaced apart generally radially projecting vanes, a stationary nozzle plate disposed adjacent the wheel and including at least one nozzle for directing a stream of fluid against the vanes, the motor housing including a support means-side portion and an atomizing device-side portion, the atomizing device-side portion including a pedestal-like portion extending generally away from the atomizing device-side portion and toward the support means-side portion and providing a distal end, the distal end including means cooperating with the nozzle plate sealably to mount the nozzle plate from the distal end, the nozzle plate cooperating with the atomizing device-side portion of the housing to provide a high-pressure chamber, the nozzle plate cooperating with the support means-side portion of the housing to provide a low-pressure chamber, the pedestal-like portion including means defining a longitudinally extending bore for rotatably supporting the shaft, the motor housing defining a driving fluid inlet to the high-pressure chamber and an exhaust for low-pressure fluid from the low-pressure chamber, the exhaust being on the support means-side portion of the housing away from the atomizing device to keep exhaust fluid away from the atomizing device, the bore opening within the motor in the low-pressure chamber and the shaft inner end being disposed in the low-pressure chamber.

4. An atomizer for attachment to a drive motor output shaft to be spun thereby, the atomizer including a central portion having an outwardly flaring radially inner surface and an outer portion having a flat generally disk-shaped surface joining the central portion inner surface, the atomizer further including a coating material cup having an outwardly flaring inner surface, the maximum diameter portion of the cup defining the base thereof, the outwardly flaring surfaces of the cup and central portion flaring in opposite directions, the cup including a right circular cylindrical lower wall portion and the atomizer central portion including a groove for receiving the lower wall portion for attaching the cup to the atomizer central portion, and the cup being provided with a plurality of apertures adjacent its base to provide communication between the cup inner surface and the central portion inner surface, and means for dispensing fluid coating material on the cup inner surface, fluid coating material dispensed on the cup inner surface as the atomizer is spun moving radially outwardly toward its base, through the apertures, along the central portion inner surface and the flat surface of the outer portion to the peripheral edge where it is atomized.

5. The apparatus of claim 4 wherein the atomizer further comprises a central bore for receiving the motor output shaft, the motor output shaft having a tapered wall and the central bore of the atomizer including a mating tapered wall portion.

6. The apparatus of claim 1 wherein the means for sealably attaching the nozzle plate to the distal end of the pedestal-like support includes means providing an annular groove in the distal end of the pedestal-like support, the groove opening toward the low-pressure side of the housing, an O-ring seal fitting the annular groove, attachment of the nozzle plate to the distal end of the pedestal-like portion compressing the O-ring seal and sealing adjacent surfaces of the nozzle plate and distal end.

7. The apparatus of claim 1 wherein the means for sealingly engaging an inner wall of the housing includes means on the nozzle plate providing a perimetral, outwardly facing surface, means providing a perimetral, outwardly opening groove in said surface, and an O-ring seal mounted in said groove and sealably engaging said inner wall of the housing

* * * * *